US006087939A

United States Patent [19]

Leyden et al.

[11] Patent Number: 6,087,939

[45] Date of Patent: Jul. 11, 2000

[54] SECURITY SYSTEM

[75] Inventors: Roger Leyden, Willow Springs; Michael Parent, Palatine, both of Ill.

[73] Assignee: Se-Kure Controls, Inc., Franklin Park, Ill.

[21] Appl. No.: 09/158,687

[22] Filed: Sep. 22, 1998

[51] Int. Cl.[7] ..... G08B 13/14

[52] U.S. Cl. ..... 340/568.2; 340/568.1; 340/686.1; 340/686.4; 340/687; 340/693.9

[58] Field of Search ..... 340/568.1, 568.2, 340/686.1, 687, 686.4, 693.9

[56] References Cited

U.S. PATENT DOCUMENTS

| | | | |
|---|---|---|---|
| 5,072,213 | 12/1991 | Close | 340/568.2 |
| 5,146,205 | 9/1992 | Keifer et al. | 340/568.2 |
| 5,341,124 | 8/1994 | Leyden et al. | 340/568.4 |
| 5,421,667 | 6/1995 | Leyden et al. | 403/406.1 |
| 5,561,417 | 10/1996 | Rothbaum et al. | 340/568.2 |
| 5,574,430 | 11/1996 | Ott et al. | 340/568.2 |
| 5,844,484 | 12/1998 | Fujiuchi et al. | 340/693.9 |

*Primary Examiner*—Glen Swann
*Attorney, Agent, or Firm*—Wood, Phillips, VanSanten, Clark & Mortimer

[57] ABSTRACT

A security assembly for an article to be monitored has a housing to be mounted to an article to be monitored, a fastener that extends into the housing and that is capable of being secured to an article to be monitored to maintain the housing in an operative position on an article to be monitored, and a switch on the housing and having first and second states. The fastener is movable relative to the housing between first and second positions. The switch is in the first state with the fastener in the first position. The switch is changed from the first state into the second state as an incident of the fastener being moved from the first position into the second position.

21 Claims, 4 Drawing Sheets

SECURITY SYSTEM

BACKGROUND OF THE INVENTION

1. Field of the Invention

This invention relates to security systems of the type used to prevent the unauthorized removal of an article from a prescribed area.

2. Background Art

Consumer electronics stores typically display a large number of products so as to allow a potential purchaser thereof to pick the products up, inspect them, and potentially effect, or simulate, operation thereof. In large display rooms, particularly at times when large numbers of people are present, the potential for theft is heightened.

The assignee herein offers a number of products which are used to avoid theft of portable articles. In U.S. Pat. No. 5,421,667, a mechanical security system is shown utilizing a housing which is attached to an article with a bolt using a preexisting, threaded bore in the article that is to be monitored. The housing fixedly maintains one end of a cable tether on the article. The other end of the cable tether is anchored to a support at a desired display location.

This type of mechanical system, while generally highly effective, can be defeated by separating the housing from the article. In some systems, this can be accomplished by directly rotating the bolt to effect release thereof, or by rotating the bolt indirectly by turning the housing through which the bolt extends.

This mechanical type system may also incorporate an elongate pin which is offset from the bolt axis and projects from the housing into the article. This avoids rotation of the housing. This system might be defeated by using a tool to exert a substantial torque on the housing which effects shearing of the offset pin to thereafter allow turning of the housing, and in turn the bolt.

Attempted removal of the housing by directly or indirectly rotating the bolt may cause the infliction of damage to the article, which is oft times expensive.

To increase the effectiveness of the security system, it is known to incorporate an electronic feature which either substitutes for the mechanical tether or is an adjunct thereto. In one system, as shown in U.S. Pat. No. 5,341,124, a switch is armed in captive relationship between the article being monitored and a housing. One may attempt to defeat this type of system by working an object between the article being monitored and the housing as the housing is separated from the article, so that the object maintains the switch in its armed state. So long as the switch can be maintained in the armed state, the housing can be separated form the article without triggering the alarm.

The industry is constantly seeking out new and better ways to monitor consumer articles. As consumer articles become smaller, and thus more susceptible to theft, and at the same time increasingly expensive, the problem of theft becomes more pronounced.

SUMMARY OF THE INVENTION

The invention is directed to a security assembly for an article to be monitored, which security assembly has a housing to be mounted to an article to be monitored, a fastener that extends into the housing and that is capable of being secured to an article to be monitored to maintain the housing in an operative position on an article to be monitored, and a switch on the housing and having first and second states. The fastener is movable relative to the housing between first and second positions. The switch is in the first state with the fastener in the first position. The switch is changed from the first state into the second state as an incident of the fastener being moved from the first position into the second position.

In one form, the housing has a through bore and the fastener is extendable into and through the through bore to engage an article to be monitored.

The fastener may be a threaded fastener.

In one form, the switch has an actuator that is movable between a normal position and an actuated position and the actuator is engaged by the fastener and moved by the fastener from the normal position into the actuated position as the fastener moves from the first position into the second position.

The fastener may be rotatable between the first and second positions.

In one form, the fastener has a peripheral surface with a switch actuator engaging portion and a switch actuator receptacle. The switch actuator engaging portion and switch actuator receptacle are circumferential ly spaced from each other on the fastener. With the fastener in the first position, the switch actuator receptacle is aligned with the switch actuator and the switch actuator is in the normal position. With the fastener in the second position, the switch actuator engaging portion engages the switch actuator and maintains the switch actuator in the actuated position.

The switch actuator may be biased towards the normal position.

The peripheral surface of the fastener may be substantially cylindrical in shape, with the switch actuator receptacle being defined by a flat on the peripheral surface.

In one form, the housing has a bore to receive the fastener and the switch actuator resides at least partially within the bore.

The bore has a central axis. In one form, the switch actuator is movable radially relative to the central axis between the normal position and the actuated position.

The housing may have a receptacle for receiving and holding an end of a security cable which can be used to restrain movement of the housing relative to a support.

In one form, the through bore has a central axis and the housing has a pin projecting in cantilever fashion substantially parallel to and spaced from the central axis to project into an article to be monitored and prevent the housing from rotating around the central axis with the fastener extending into and through the through bore and into an article to be monitored.

In one form, the housing has first and second oppositely facing sides, with the first side being abuttable to an object to be monitored. An adaptor on the second side facilitates mounting of the housing to a support for an article to be monitored to which the housing is attached.

The invention is also directed to a security system having an alarm system having an unbreached state and a breached state, which alarm system produces a detectable signal with the alarm in the breached state. The security system further has a security assembly for an article to be monitored, which security assembly has a housing to be mounted to an article to be monitored, a fastener that extends into the housing and that is capable of being secured to an article to be monitored to maintain the housing in an operative position on an article to be monitored, and a switch on the housing and having first and second states. The fastener is movable relative to the housing between first and second positions. The switch is in the first state with the fastener in the first position. The switch is changed from the first state into the second state as an incident of the fastener being moved from the first position into the second position. The switch and alarm system are interconnected so that the alarm system changes from the unbreached state into the breached state as an incident of the switch changing from the second position into the first position.

The security system may further include an article to be monitored to which the housing is attached through the fastener.

At least two conductors may connect between the housing and alarm system to define a part of a continuous conductive path with the switch in the second state. With the switch in the first state, the continuous conductive path is interrupted, as an incident of which the alarm system assumes the breached state.

The security system may further include a cable that is separate from the first and second conductors, a connector on the cable, and a receptacle on the housing for receiving and holding the cable connector. The cable can be connected to a support to restrain movement of the housing relative to a support.

DETAILED DESCRIPTION OF THE DRAWINGS

Figure 1:
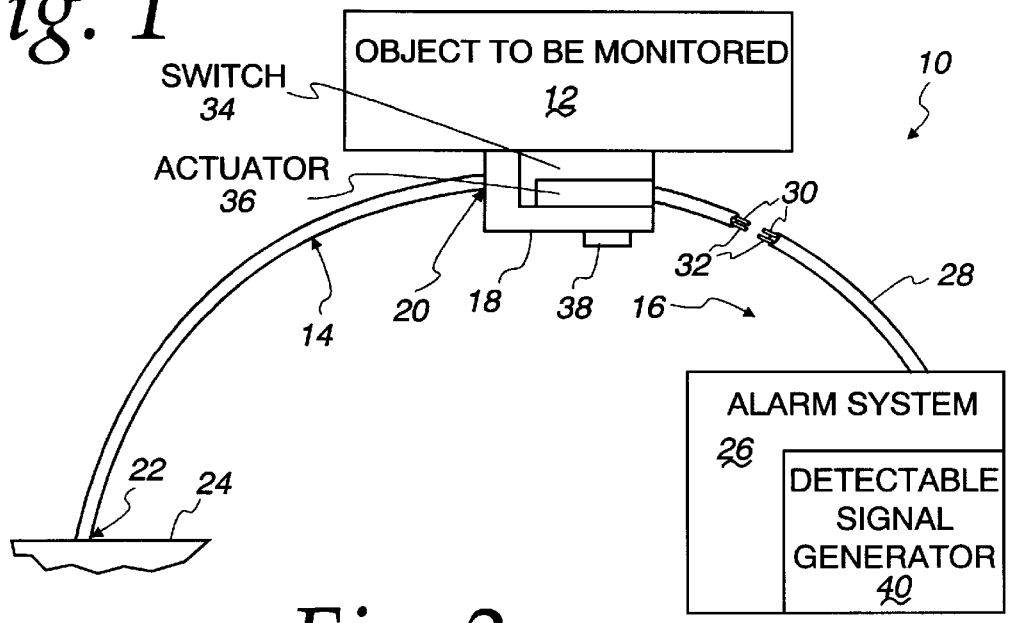
FIG. 1 is a schematic representation of a security system, according to the present invention.

In FIG. 1, a security system, according to the present invention, is shown schematically at 10. The security system 10 is designed to confine an object to be monitored 12 to a prescribed area. The object to be monitored 12 may be any portable article, such as those displayed in electronics stores. For example, cameras, recorders, telephones, etc., are commonly displayed in these stores on shelves and are made accessible to be picked up by a consumer, as for inspection and operation thereof.

In the security system 10 shown, a mechanical restraint at 14 and an electronic monitoring system at 16 are shown. The mechanical restraint 14 is potentially redundant, and thus optional.

Generally, the security system 10 consists of a housing 18 which is attached to the object to be monitored 12. One end 20 of the mechanical restraint 14 is secured to the housing 18, with the other end 22 of the mechanical restraint 14 anchored at a support 24.

The electronic monitoring system 14 consists of an alarm system 26, as shown for example in U.S. Pat. No. 5,341,124, which is incorporated herein by reference. The alarm system 26 has a cord 28 with two conductors 30, 32 which define part of a conductive loop. The conductors 30, 32 are connected to a switch 34, which has first and second states, as dictated by an actuator 36 which is repositionable between a normal position and an actuated position. A fastener 38 is employed to maintain the housing 18 on the object to be monitored 12 and is repositionable relative to the housing 18 between first and second positions. By changing the position of the fastener 38 from the first position into the second position, the actuator 36 is changed from its normal position into its actuated position to thereby establish a continuous conductive path through the conductors 30, 32. Movement of the fastener 38 from the second position into the first position causes the actuator 36 to reposition from its actuated position into its normal position, which changes the switch 34 from its second state into its first state, as an incident of which the continuous conductive path is interrupted. This changes the alarm system 26 from an unbreached state to a breached state. As this occurs, a signal generator 40 on the alarm system 28 generates a detectable signal to alert the individual monitoring the system that the security system 10 has been tampered with. The details of the security system 10, as just generally described, will now be described in greater detail, below.

Referring initially to FIGS. 2–9, one form of the security system 10 is shown. The housing 18, in this embodiment, has a generally rectangular overall shape with oppositely facing surfaces 42, 44. The surface 42 is designed to be facially abutted to the object to be monitored 12 and is secured thereto through the fastener 38. In this case, the fastener 38 is threaded and is designed to extend into a pre-threaded bore as commonly found on various cameras.

The housing 18 has a first cavity 46 formed through the surface 42. The cavity 46 accommodates an enlarged connector 48 which can be crimped to, or otherwise secured at, the end 20 of the restraint 14. The restraint 14 may be a braided metal wire cable to which the connector 48 attaches. With the opposite cable end 22 attached to the support 24, movement of the housing 18 is confined to a prescribed area as dictated by the length of the mechanical restraint 14.

The housing 18 has a second cavity 50 formed therein to accommodate a printed circuit board 52, with components such as a current limiting resistor 53, and the switch 34. To facilitate formation of the cavity 50 and placement of the printed circuit board 52 and switch 34, the main portion of the housing 18 is formed as two parts, including a main body 54 and a cover 56. The cavity 50 can be formed through a surface 58 of the main body 54 facing oppositely to the surface 42. After the printed circuit board 52 and switch 34 are assembled in the cavity 50, the cover 56 can be secured to the main body 54 through friction fit fasteners or screws 60, to thereby substantially close the cavity 50.

The fastener 38 is accommodated by a stepped bore 60 through the main body 54 and cover 56 and having an axis 62. The switch 34 has a housing 64 to which an actuator 66 is mounted for movement between a normal position, shown with the switch 34 at position A in FIG. 9, and an actuated position, shown with the switch 34 at position B in FIG. 9. The actuator 66 is normally urged by a bias element 68 outwardly from the housing 64 to the normal position.

The actuator housing 64 is mounted to the body 18 so that the actuator 66 projects into the bore 60 at a location fully within the bore 60 and, in this embodiment, approximately midway between the body surfaces 42, 44.

The fastener 38 is designed to reposition the actuator 66 from the normal position into the actuated position as the fastener 38 is repositioned relative to the housing 18. As a result of the actuator 66 changing from the actuated position into the normal position, the conductive path defined through the conductors 30, 32 is interrupted, which causes the alarm system 26 to assume the breached state as a result of which the signal generator 42 generates a signal alerting the user to the fact that the housing 18 has been tampered with.

More specifically, the fastener 38 has a threaded shank 72 which terminates at an enlarged head 74. The head 74 has a receptacle 76 which accommodates a tool (not shown) that facilitates rotation of the fastener 38 about its central axis 78, which coincides with the axis 62.

Figure 6:
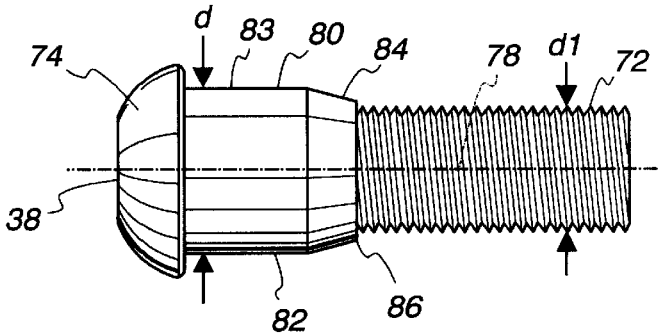
FIG. 6 is an enlarged, side elevation view of a fastener used to maintain the housing in FIGS. 1–5 on an object to be monitored.
Figure 7:
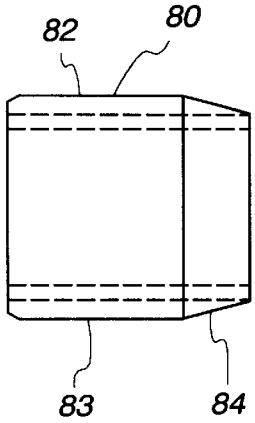
FIG. 7 is an enlarged, side elevation view of an adaptor on the fastener in FIG. 5 used to actuate a switch on the housing.

In this embodiment, the fastener 38 is fit with an adapter 80 which slides over the shank 72 and can be crimped to be held at the position shown in FIG. 6. The adapter 80 has a cylindrical body 82 with an actuator engaging portion/surface 83 having a substantially uniform diameter d which is larger than the diameter dl of the shank 72. The end of the body 82 remote from the head 74, has a tapered surface portion 84 which terminates at an edge 86 which closely surrounds the shank 72.

The diameter d of the body 82 is selected to be slightly smaller than the diameter of the entry portion 88 of the bore 60. More significantly, the diameter d is chosen so that with the body 82 axially coinciding with the switch actuator 66, the body 82 urges the actuator 66 from the normal position into the actuated position therefor, thereby causing the continuous conductive path through the conductors 30, 32 to be established.

In one form of the invention, a flat 90 is formed on one portion of the body 82. The flat 90 causes the effective diameter of the body 82 to be reduced at the circumferential location of the flat 90. The flat 90 is configured to define a receptacle for the switch actuator 66, so that with the switch actuator 66 circumferentially aligned therewith, as shown with the switch 34 at the location A in FIG. 9, the switch actuator 66 is allowed to be biased outwardly to the normal position therefor, which causes the continuous conductive path through the conductors 30, 32 to be interrupted, which changes the alarm system 26 from an unbreached state to the breached state, in turn causing the alarm system 26 to detect the interruption and cause the signal generator 42 to generate a signal to be detected by the user.

Figure 9:
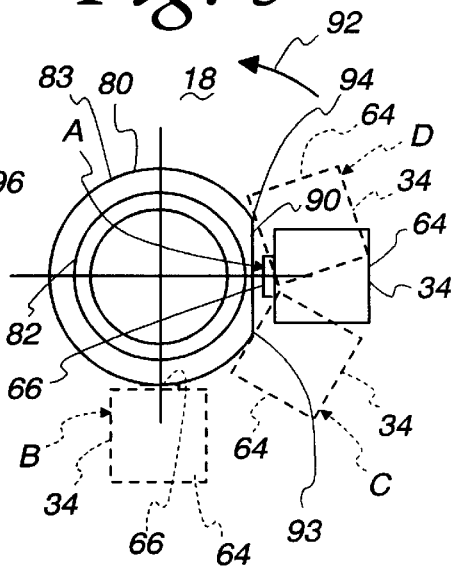
FIG. 9 is a view as in FIG. 8 and showing the adaptor in different positions relative to the housing switch.

As can be seen in FIG. 9, the actuator 66 changes between the normal and actuated positions therefor for each rotation of the fastener 38, with the body 82 axially aligned with the actuator 66. In FIG. 9, the body 18 is shown being rotated in the direction of the arrow 92. In the B location for the switch 34, the body 82 maintains the actuator 66 depressed to the actuated position therefor. Continued rotation causes the switch actuator 66 to encounter one circumferential edge 93 of the flat 90 with the switch 34 shown at position C, in which position the switch actuator 66 remains depressed. Further rotation causes the switch to realize the A position therefor in which the actuator 66 is allowed to move outwardly to the normal position therefor, which causes the alarm system to assume the breached state. Further rotation causes the switch actuator 66 to assume the D position, in which the switch actuator 66 encounters the opposite circumferential edge 94 of the flat 90 which again causes a depression of the actuator 66 to change the actuator 66 from the normal position to the actuated position.

It can be seen that the actuator 66 is changed from the normal position into the actuated position as an incident of the fastener 38 changing from a first position, in which the flat 90 is aligned with the actuator 66, or the fastener 38 is fully separated from the housing 18, and a second position, wherein the non-flatted, actuator engaging portion of the surface 83 is circumferentially aligned with the actuator 66.

With this arrangement, the system is armed by manipulating the fastener 38 so that the fastener 38 is moved from the first position into the second position therefor. A would be thief attempting even a partial turn of the fastener 38 places the fastener in the first position and causes the actuator 66 to move from the actuated position to the normal position, which results in the alarm system 26 changing to the breached state.

Assembly of the fastener 38 is facilitated by the tapered surface portion 84, which guides the switch actuator 66 between the shank 72 and body 82 without hangup.

Figure 8:
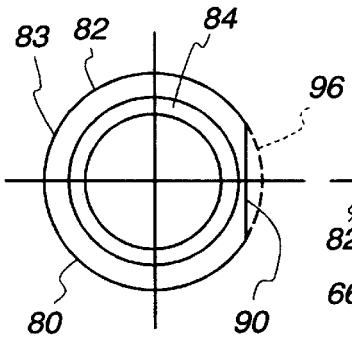
FIG. 8 is an enlarged, plan view of the adaptor in FIG. 7.

In an alternative embodiment, as shown in FIG. 8, the body 82 can be formed with a uniform diameter, as indicated by the dotted lines 96. As a result, the corresponding first position for the fastener is that in which the fastener 38 is either fully separated from the housing 18 or only partially in the bore 60 so that the body 82 does not encounter the actuator 66. A corresponding second position for the fastener 38 is realized as the body 82 axially aligns with, and depresses the actuator 66. With this embodiment, substantial unscrewing of the fastener 38 usually must occur to change the actuator 66 from the actuated position into the normal position.

While the fastener adapter 80 is shown as a separate element, it is possible to machine the fastener 38, as one piece, to the shape of the adaptor 80.

Figure 4:
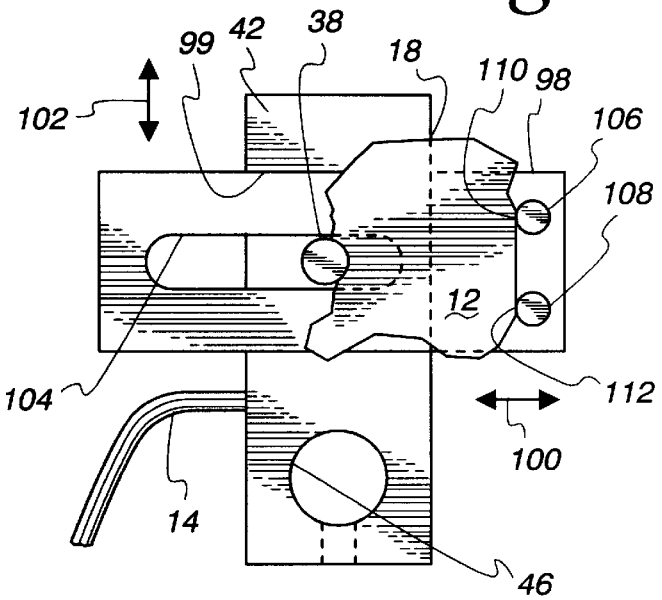
FIG. 4 is an enlarged, top view of the housing in FIGS. 1 and 2, including a stabilizing element.
Figure 5:
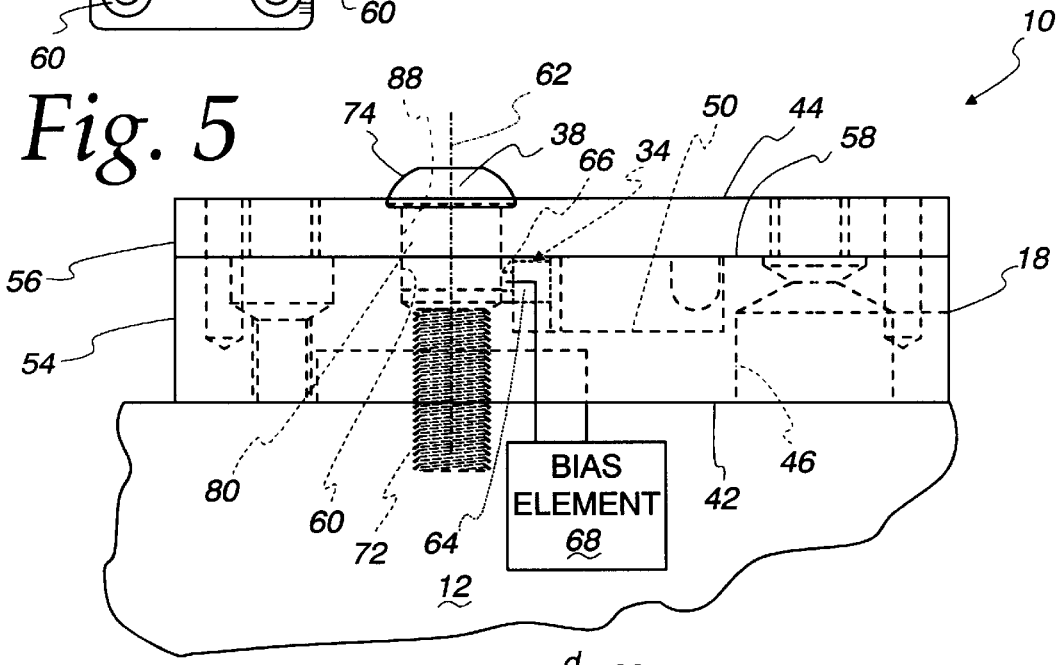
FIG. 5 is an enlarged, side elevation view of the housing in FIGS. 1–4.

As seen in FIG. 4, to stabilize the connection of the housing 18 to the article to be monitored 12, a stabilizing element 98 can be provided. The stabilizing element 98 is guided in an undercut slot 99 for translatory movement in the direction of the double-headed arrow 100, which is orthogonal to the longer dimension of the body 18, as indicated by the double-headed arrow 102. The fastener 38 extends through the bore 60 and an elongate slot 104 in the stabilizing element 98 so that the stabilizing element 98 is captive between the housing 18 and the object to be monitored 12 with the fastener 38 tightened. The elongate slot 104 allows the stabilizing element 98 to be shifted relative to the housing 18 along the line as indicated by the arrow 100.

Two pins 106, 108 project in cantilever fashion from the stabilizing element 98 and define shoulders 110, 112, respectively, which are abuttable to the article to be monitored 12, as shown in FIG. 4. With the fastener 38 extended through the housing 18 and stabilizing element 98 and tightened against the article to be monitored 12, the selected relative positions of the housing 18 and stabilizing element 98 become fixed. The stabilizing element 98 can be pre-positioned so that the shoulders 110, 112 abut to the article to be monitored 12. The stabilizing element 98 thus prohibits pivoting of the housing 18 and stabilizing element 98 relative to the article to be monitored 12, as might be attempted to loosen the fastener 38. This arrangement is shown in co-pending application Ser. No. 09/094,131.

Figure 2:
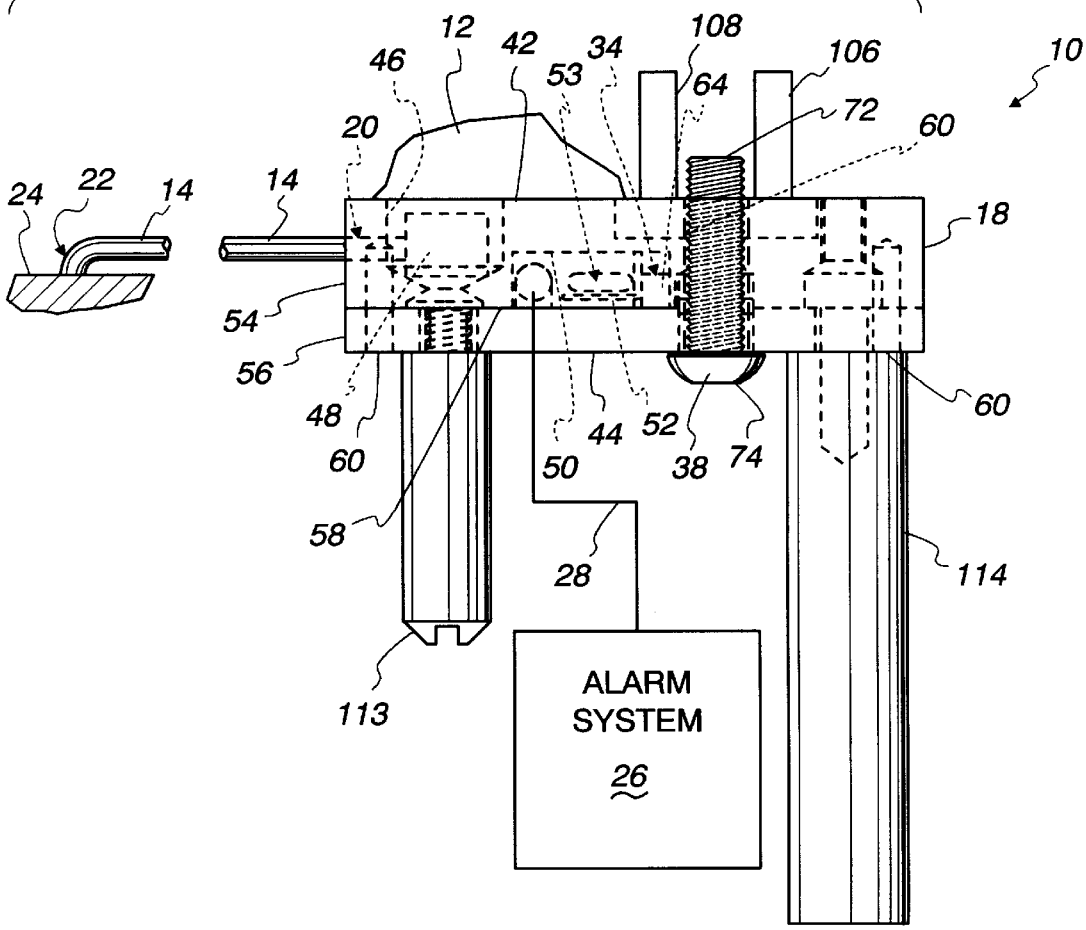
FIG. 2 is an enlarged, side elevation view of a housing on the security system of FIG. 1.
Figure 3:
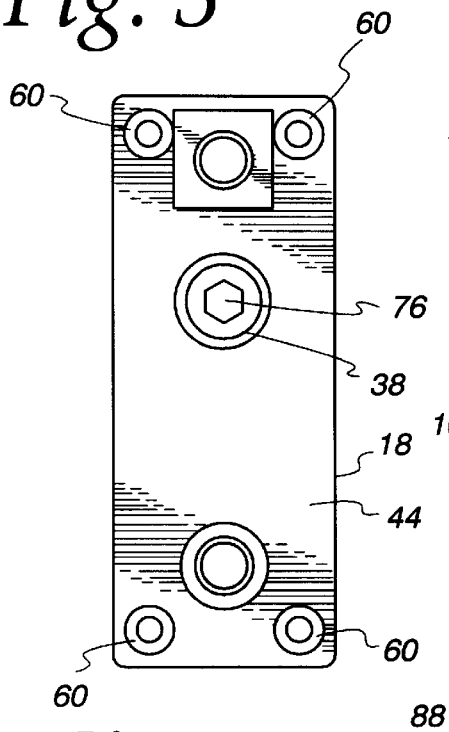
FIG. 3 is an enlarged, bottom view of the housing in FIG. 2.

As seen in FIG. 2, adaptors 113, 114 may be provided on the housing surface 44 to facilitate mounting of the housing 18 to a stand, or the like, as shown, for example, in U.S. Pat. No. 5,341,124.

Figure 10:
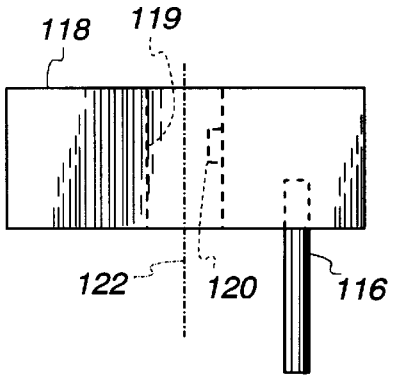
FIG. 10 is a side elevation view of a modified form of housing, according to the present invention.
Figure 11:
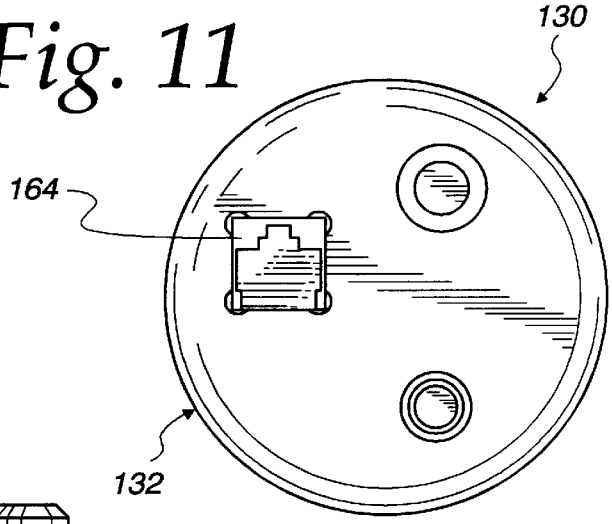
FIG. 11 is a plan view of a modified form of security assembly, according to the present invention.
Figure 12:
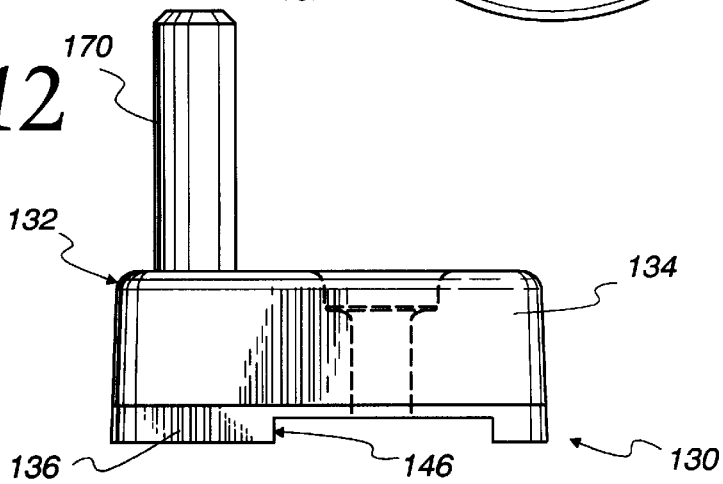
FIG. 12 is a side elevation view of the security assembly in FIGS. 11.
Figure 13:
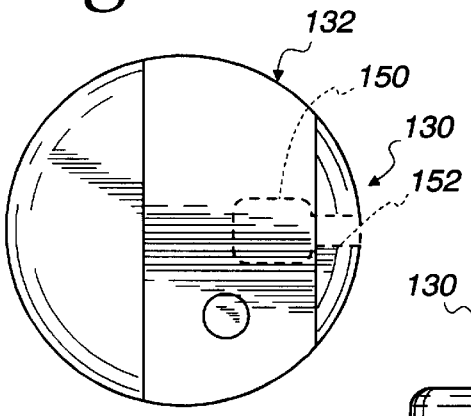
FIG. 13 is a bottom view of the security assembly in FIGS. 11 and 12.
Figure 16:
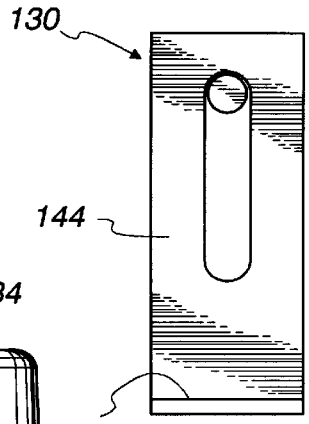
FIG. 16 is a bottom view of a stabilizing element on the security assembly of FIGS. 11–15.
Figure 14:
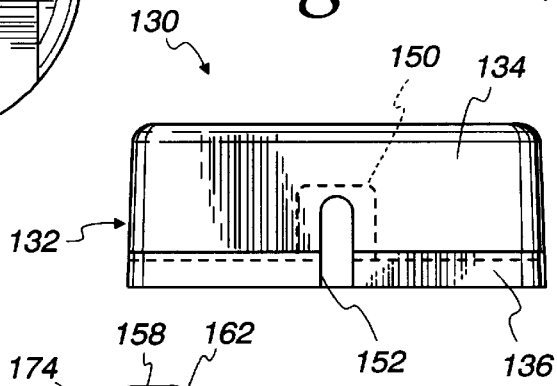
FIG. 14 is a side elevation view of the security assembly in FIGS. 11–13.

As an alternative to the use of a stabilizing element 98, a pin 116 can be used, as shown in a modified form of the housing 118 in FIG. 10. The housing 118 has a through bore 119 to accept the fastener 138, with there being a switch actuator 120, corresponding to the actuator 66, within the bore 119. The pin 116 projects in cantilever fashion and is offset from the axis 122 of the bore 119. The pin 116 can project into the object to be monitored 12 to prevent the housing 118 from being rotated around the axis 122, as in an attempt to release the fastener 38.

In FIGS. 11–17, a modified form of security assembly, for use with the alarm system 26, as previously described, is shown at 130. The security assembly 130 consists of a housing 132 with a main body 134 and a cover 136. The housing 132 has a generally cylindrical shape. The housing 132 his a through bore 140 to accommodate a fastener 142 which mounts the housing 132 to the article to be monitored 12. A stabilizing element 144, corresponding to the stabilizing element 98, moves guidingly in translation within an undercut slot 146 and has an L shape with a projecting shoulder 148 which performs the function of the shoulders 110, 112 on the pins 106, 108 on the stabilizing element 98. The stabilizing element 144 otherwise cooperates with the housing 132 in the same fashion as the stabilizing element 98 cooperates with the housing 18, as previously described.

The main body has a cavity 150 to accommodate the connector 48 on the mechanical restraint 14. A cable outlet 152 permits passage of the mechanical restraint 14 from the cavity 150 to externally of the housing 132. With the cover 136 in place, the connector 48 is maintained captively within the cavity 150.

A separate cavity 154 is provided in the housing 132 to accommodate the switch 34 and printed circuit board 52. The switch 34 is situated so that the actuator 66 associated therewith resides within the bore 140, as iii the previously described embodiment.

The fastener 142 has a shank 156, an enlarged head 158 and an adaptor 160. The adaptor 160 has a body 162 which has the same general shape as the body 82 or the modified form thereof shown in phantom lines in FIG. 8.

In this embodiment, the housing 132 has an exposed connector 164, which may be a conventional female telephone jack connector. The cord 28 is connected from the alarm system 26 to a male jack connector 166 which can be snap fit to the connector 164.

A post/adaptor 170 is mounted to the housing 132 to facilitate mounting of the housing 132 to a support for the housing 132, of the type shown, for example, in FIGS. 33 and 34 of U.S. Pat. No. 5,341,124.

The security assembly 130 can be constructed to function in the same manner as the embodiment previously described. That is, by rotating the fastener 142, the conductive path, established at least in part by the cord 28, is interrupted.

Figure 15:
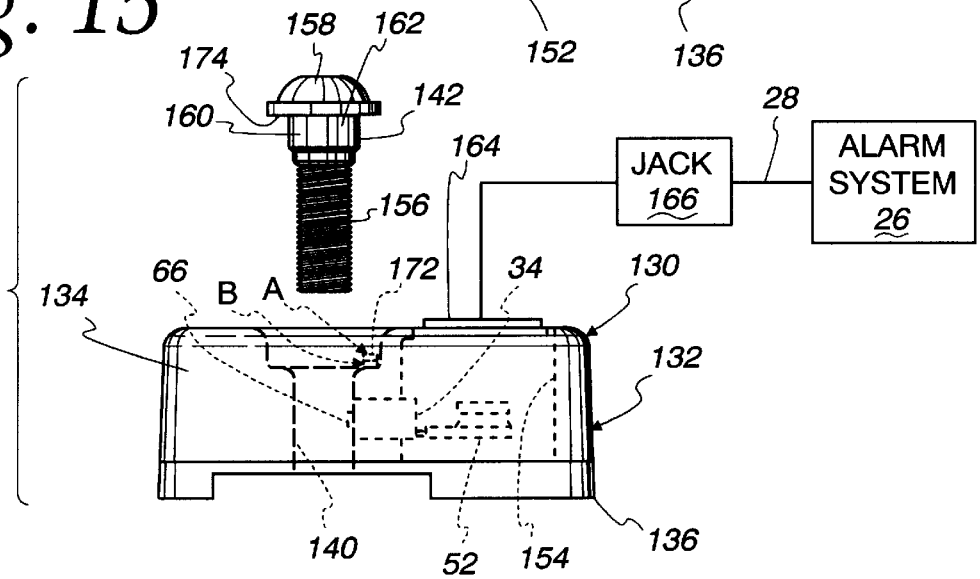
FIG. 15 is a side elevation view of the security assembly in FIGS. 11–14.
Figure 17:
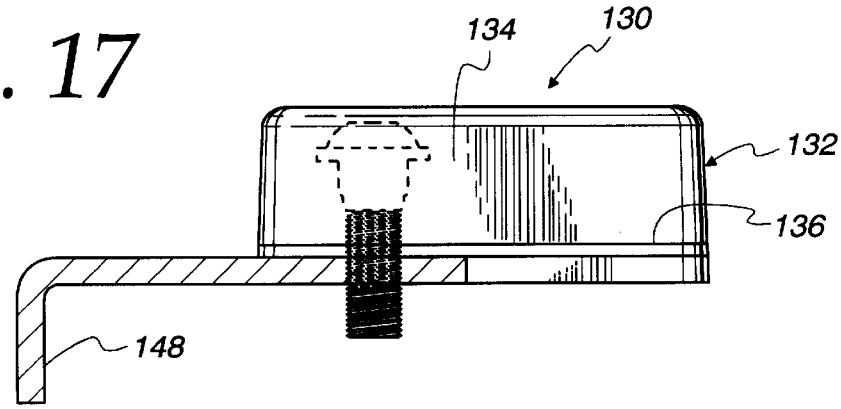
FIG. 17 is a side elevation view of the security assembly in FIGS. 11–16 with the stabilizing element operatively connected thereto.

In FIG. 15, a modified form of switch arrangement is shown. In FIG. 15, a switch actuator 172 is oriented so that it can be depressed axially of the bore 140 by a flange surface 174 on the fastener 142, from a normal position as shown at A to an actuated position as shown at B.

The foregoing disclosure of specific embodiments is intended to be illustrative of the broad concepts comprehended by the invention.

What is claimed is:

1. A security assembly for an article to be monitored, said security assembly comprising:

a housing to be mounted to the article to be monitored;

a fastener that extends into the housing and that is capable of being secured to the article to be monitored to maintain the housing in an operative position on the article to be monitored, the fastener being movable relative to the housing between first and second positions; and a switch on the housing having first and second states, the switch being in the first state with the fastener in the first position, the switch being changed from the first state into the second state as an incident of the fastener being moved from the first position into the second position with the housing in a fixed position relative to the article to be monitored.

2. The security assembly according to claim 1 wherein the housing has a through bore and the fastener is extendable into and through the through bore to engage the article to be monitored.

3. The security assembly according to claim 2 wherein the through bore has a central axis and the housing has a pin projecting in cantilever fashion substantially parallel to and spaced from the central axis to extend into the article to be monitored and prevent the housing from rotating around the central axis with the fastener extending into and through the through bore and into the article to be monitored.

4. The security assembly according to claim 1 wherein the fastener comprises a threaded fastener.

5. The security assembly according to claim 1 wherein the housing has a receptacle for receiving and holding an end of a security cable which can be used to restrain movement of the housing relative to a support.

6. The security assembly according to claim 1 wherein the housing has first and second oppositely facing sides, the first side is abuttable to an object to be monitored and there is an adaptor on the second side to facilitate mounting of the housing to a support for an article to be monitored to which the housing is attached.

7. A security assembly for an article to be monitored, said security assembly comprising:

a housing to be mounted to the article to be monitored;

a fastener that extends into the housing and that is capable of being secured to the article to be monitored to maintain the housing in an operative position on the article to be monitored, the fastener being movable relative to the housing between first and second positions; and a switch on the housing having first and second states, the switch being in the first state with the fastener in the first position, the switch being changed from the first state into the second state as an incident of the fastener being moved from the first position into the second position, wherein the switch has an actuator that is movable between a normal position and an actuated position and the actuator is engaged by the fastener and moved by the fastener from the normal position into the actuated position as the fastener moves from the first position into the second position.

8. The security assembly according to claim 7 wherein the fastener is rotatable between the first and second positions.

9. The security assembly according to claim 7 wherein the fastener has a peripheral surface with a switch actuator engaging portion and a switch actuator receptacle, the switch actuator engaging portion and switch actuator receptacle being circumferentially spaced from each other on the fastener, whereby when the fastener is in the first position the switch actuator receptacle is aligned with the switch actuator and the switch actuator is in the normal position, and when the fastener is in the second position the switch actuator engaging portion engages the switch actuator and maintains the switch actuator in the actuated position.

10. The security assembly according to claim 9 wherein the switch actuator is biased towards the normal position.

11. The security assembly according to claim 9 wherein the peripheral surface of the fastener is substantially cylindrical in shape and the switch actuator receptacle is defined by a flat on the peripheral surface.

12. The security assembly according to claim 7 wherein the housing has a bore to receive the fastener and the switch actuator resides at least partially within the bore.

13. The security assembly according to claim 12 wherein the bore has a central axis and the switch actuator is movable radially relative to the central axis between the normal position and actuated position.

14. A security system comprising:

an alarm system having an unbreached state and a breached state and producing a detectable signal with the alarm in the breached state; and a security assembly for an article to be monitored, the security assembly comprising:

a housing to be mounted to the article to be monitored;

a fastener that extends into the housing and that is capable of being secured to the article to be monitored to maintain the housing in an operative position on the article to be monitored, the fastener being movable relative to the housing between first and second positions; and a switch on the housing having first and second states, the switch being in the first state with the fastener in the first position, the switch being changed from the first state into the second state as an incident of the fastener being moved from the first position into the second position with the housing in a fixed position relative to the article to be monitored, wherein the switch and alarm system are interconnected so that the alarm system changes from the unbreached state into the breached state as an incident of the switch changing from the second position into the first position.

15. The security system according to claim 14 further comprising an article to be monitored and wherein the housing is attached to the article to be monitored using the fastener.

16. The security system according to claim 15 wherein there are at least two conductors connecting between the housing and alarm system and defining a part of a continuous conductive path with the switch in the second state and with the switch in the first state the continuous conductive path is interrupted as an incident of which the alarm system assumes the breached state.

17. The security system according to claim 16 further comprising a cable that is separate from the first and second conductors, a connector on the cable, and a receptacle on the housing for receiving and holding the cable connector, whereby the cable can be connected to a support to restrain movement of the housing relative to a support.

18. The security system according to claim 15 wherein the fastener comprises a threaded fastener.

19. A security system comprising:

an alarm system having an unbreached state and a breached state and producing a detectable signal with the alarm in the breached state; and a security assembly for an article to be monitored, the security assembly comprising:

a housing to be mounted to the article to be monitored;

a fastener that extends into the housing and that is capable of being secured to the article to be monitored to maintain the housing in an operative position on the article to be monitored, the fastener being movable relative to the housing between first and second positions; and a switch on the housing having first and second states, the switch being in the first state with the fastener in the first position, the switch being changed from the first state into the second state as an incident of the fastener being moved from the first position into the second position, wherein the switch and alarm system are interconnected so that the alarm system changes from the unbreached state into the breached state as an incident of the switch changing from the second position into the first position, wherein the switch has an actuator that is movable between a normal position and an actuated position and the actuator is engaged by the fastener and moved by the fastener from the normal position into the actuated position as the fastener moves from the first position into the second position.

20. The security system according to claim 19 wherein the fastener has a peripheral surface with a switch actuator engaging portion and a switch actuator receptacle, the switch actuator engaging portion and switch actuator receptacle being circumferentially spaced from each other on the fastener, with the fastener in the first position the switch actuator receptacle is aligned with the switch actuator and the switch actuator is in the normal position, and with the fastener in the second position the switch actuator engaging portion engages the switch actuator and maintains the switch actuator in the actuated position.

21. A security system comprising:

an alarm system having an unbreached state and a breached state and producing a detectable signal with the alarm in the breached state; and a security assembly for an article to be monitored, the security assembly comprising:

a housing to be mounted to the article to be monitored;

a fastener that extends into the housing and that is capable of being secured to the article to be monitored to maintain the housing in an operative position on the article to be monitored, the fastener being movable relative to the housing between first and second positions; and a switch on the housing having first and second states, the switch being in the first state with the fastener in the first position, the switch being changed from the first state into the second state as an incident of the fastener being moved from the first position into the second position, wherein the switch and alarm system are interconnected so that the alarm system changes from the unbreached state into the breached state as an incident of the switch changing from the second position into the first position, wherein the housing has a bore to receive the fastener and the switch actuator resides at least partially within the bore.

* * * * *